US006015489A

United States Patent [19]

Allen et al.

[11] Patent Number: 6,015,489

[45] Date of Patent: Jan. 18, 2000

[54] PLASTIC SELF-RELIEVING CURB INLET FILTER

[75] Inventors: Larry James Allen; Bridgette Lyniece Allen, both of Hockley, Tex.

[73] Assignees: Larry J. Allen; Bridgett L. Allen, both of Hockley, Tex.

[21] Appl. No.: 09/009,442

[22] Filed: Jan. 19, 1998

[51] Int. Cl.[7] ..... E03F 5/06

[52] U.S. Cl. ..... 210/131; 210/163; 210/232; 210/459; 404/4; 156/71

[58] Field of Search ..... 210/162, 131, 210/163, 130, 164, 169, 232, 459, 463, 170; 404/2, 4; 156/71

[56] References Cited

U.S. PATENT DOCUMENTS

| | | |
|---|---|---|
| 506,267 | 10/1893 | Sefton . |
| 672,868 | 4/1901 | Banwell . |
| 693,511 | 2/1902 | Garrett et al. . |
| 783,556 | 2/1905 | Van Buskirk . |
| 1,397,471 | 11/1921 | Walker . |
| 1,666,756 | 4/1928 | Sass . |
| 1,711,674 | 5/1929 | Egan . |
| 3,587,239 | 6/1971 | Feland . |
| 3,797,188 | 3/1974 | Mansfed . |
| 3,881,832 | 5/1975 | Maguire . |
| 3,914,911 | 10/1975 | Paasch . |
| 3,945,746 | 3/1976 | Bredbenner . |
| 4,301,557 | 11/1981 | Walraven . |
| 4,345,998 | 8/1982 | Graffis et al. . |
| 4,356,087 | 10/1982 | Miles . |
| 4,419,323 | 12/1983 | Arntyr . |
| 4,460,462 | 7/1984 | Arneson . |
| 4,561,975 | 12/1985 | Schloss . |
| 4,594,157 | 6/1986 | McGowan . |
| 4,610,566 | 9/1986 | Albang et al. . |
| 4,883,590 | 11/1989 | Papp . |
| 4,935,132 | 6/1990 | Schaier . |
| 5,024,550 | 6/1991 | Mainville . |
| 5,037,541 | 8/1991 | Ruey-Jang . |
| 5,069,781 | 12/1991 | Wilkes . |
| 5,130,016 | 7/1992 | Gavin . |
| 5,223,154 | 6/1993 | MacPherson et al. . |
| 5,232,587 | 8/1993 | Hegemier et al. . |
| 5,284,580 | 2/1994 | Shyh . |
| 5,376,264 | 12/1994 | Betancourt . |
| 5,403,474 | 4/1995 | Emery . |
| 5,480,254 | 1/1996 | Autry . |
| 5,587,072 | 12/1996 | Regan . |
| 5,702,595 | 12/1997 | Mossburg, Jr. . |

FOREIGN PATENT DOCUMENTS

| | | |
|---|---|---|
| 2376918 | 6/1978 | France . |
| 470992 | 3/1937 | United Kingdom . |

*Primary Examiner*—David A. Simmons
*Assistant Examiner*—Fred Prince

[57] ABSTRACT

A self-relieving curb inlet filter, for intercepting debris, to be positioned in the opening of conventional pre-cast and cast-in-place curb inlets, for reducing water pollution in lakes, rivers, streams, and oceans. The present invention is one-piece molded apparatus with screened grid configuration of vertical and horizontal members spaced to allow liquids and small debris to go into the storm sewer system while intercepting large sized debris. The present invention permits accumulated debris collected to be released into the storm sewer system, usually during heavy rainfall events, when flow/debris pressure, against the present invention, increases sufficiently to move/open the present invention. The present invention moves/returns to the original position when flow/debris accumulation pressure decreases from the present invention.

2 Claims, 7 Drawing Sheets

PLASTIC SELF-RELIEVING CURB INLET FILTER

BACKGROUND

1. Field of the Invention

This invention relates to a debris intercepting screen, positioned in the opening of curb inlets, for reducing water pollution in natural lakes, rivers, streams, and oceans.

2. Description of the Prior Art

The presence of debris in our waterways and along our shorelines continues to pose serious health, economic, and environmental consequences. The sight of waste materials such as aluminum cans, glass bottles, plastic containers, shoes, and the like, floating on streams and waterways is a visible reminder to the public of contamination and pollution of the water supply.

Much of the debris littering our watersupply areas and beaches does not wash ashore from the ocean, but originates on land, usually as a result of inadequate waste management practices and undiscriminating roadway liter from traveling motorists.

The effect of debris moving from inland areas through judiciously placed curb inlets to convey storm water run-off from paved roads, streets, and highways to discharge locations, such as drainage ponds, natural rivers, lakes, and streams, is evident in the waterways of many urban communities.

Presently, there is no attempt to prevent non-perishable and slow decomposing debris from entering curb inlets which serves which are connected to the storm sewer drainage systems. Conventional curb inlets simply provide an unobstructed opening in the curb construction. The usual opening dimensions of a curb inlet without an extension is 5 feet (length)×6" (height), 10 feet (length)×6" (height) for curb inlets with one extension, and 15 feet (length)×6" (height) for curb inlets with two extensions.

Too often curb inlets are used as inconspicuous garbage receptacles. Some debris remain inside storm sewers, eventually accumulates and clogs the drainage pipe until they decompose (which may take years depending on the material) or until heavy rains push them through the drainage system.

An analysis of underwater debris collected revealed that 62.4% were composed of materials such as plastic bottles, cups, glass pieces and metal cans. Furthermore, the decomposition time for plastic materials is approximately 164 years. It is evident that public awareness campaigns, to promote citizen responsibility and environmental stewardship regarding urban inland waste and its impact on aquatic environments, are positive steps but more is needed-water is a valuable natural resource. As the worldwide population increases, if nothing is done to intercept trash before entering the storm sewer drainage systems, it is inevitable there will be an enormous amount of debris deposited in our "fishable and swimmable" lakes, rivers, and streams.

Furthermore, the construction of streets, highways, office buildings, shopping centers, restaurants, apartment houses, sports complexes and the like, produces more trash which is persuaded by rain and winds or traveling motorists, into curb inlets. It is unacceptable to allow this continued and subtle method of polluting the natural watersupply areas.

Prior art contains disclosures of sewage systems in which filters are placed within the throat of curb inlets to prevent sediment and solid foreign objects from entering drainage pipes and some of these include a removable basket in which the filtered-out solid material is retained to facilitate cleaning and replacement. However, in the prior art, the filters, when fUll of sediment, can obstruct flow of water, are usually made of metals (which are sometimes the source of theft), are expensive to manufacture, are extremely heavy, and require various machines or a number of workers to install .

U.S. Pat. No. 658,639 (Guion) discloses a receiving basin for a sewer system which is divided by a vertical screen into compartments. A removable metal basket is normally housed in the compartments which contain filtration material.

U.S. Pat. No. 809,201 Lutz) discloses a receiving basin for sewage system that receives surface water from streets. The receiving basin is intended to catch sediment in the water and prevent it fro m being carried into the sewer. The basin houses a removable basket into wh ich in coming surfac e water is directed. T he basket has a main, screened opening through which surface water passes from the basket through the basin, and subsidiary outlets. Subsidiary outlet allows water to escape around the basket if the basket is full of sediment. U.S. Pat. No. 1,746,121 (Levy) discloses a catch basin for a sewer in which the basin is provided between its inlet and the sewer, with a removable basket into which incoming water is directed and which re tains solid materials.

U.S. Patent No. 2,102,31 (gan) discloses a removable rece ptacle for inse rtion within a receiv ing basin of a sewer. The receptacle has a spiral arrangement of discharge ports through which incoming water ca n flow to the sewer.

U.S. Pat. No. 2,615,526 (Lane) discloses a catch basin for a sewer which is provided with a removal filter basket formed of a screen, angle irons and sheets.

U.S. Pat. No. 4,382,713 (Kawahara) discloses an apparatus for reducing wastage for water draining from pavements by letting storm runoff move into a container filled with pebbles or foam concrete so that the water can be disbursed into the underlying ground.

U.S. Pat. No. 4,419,232 (Arntyr) discloses a filter for outdoor drains in roadways, etc., comprising a grating, below which is mounted a course filtering wire basket and below that, a fine filtering bag of flexible water-permeable cloth fabric.

U.S. Pat. No. 4,594,157 (McGowan) discloses an expensive metal inlet clamp for affixing to a cover over a storm sewer inlet to mount a screen to protect the curb entrance to the sewer, comprising a generally F-shaped bracket. However, the device utilizes steel or cast iron clamps and can only be used with curb inlets having a cast iron or steel cover. Most industry standard curb inlets manufactured presently, are fabricated out of concrete or are pre-cast concrete units. Thus, this device cannot be used with industry standard pre-cast or cast in place concrete curb inlets. The device also uses thumb bolts, nuts, washers, and the entire assembly is heavy—increasing the compressive stress load on the structure. Installation of the device is extremely labor intensive.

U.S. Pat. No. 5,133,619 (Murfae), discloses a removable metal filter basket housed in a basin disposed in an alternative runoff path upstream from the stormwater receiving basin. The basket contains a dischargeable filtration media and lifting channels which enable the basket to be removed from the basin by the tines of conventional waste disposal vehicles.

U.S. Pat. No. 5,232,587 (Hegemier) discloses a curb inlet filter that is placed into the throat of an inlet and composed of a perforated aluminum section riveted to a tubular steel frame. A grate type rack is constructed across hydraulic openings. The metal filter has at least one welded handle and the entire filter rests on angle supports that are retrofitted to the interior walls of the inlet made of welded aluminum and tubular steel frames placed on retrofitted angle iron supports, mounted on the walls of the storm sewer basin, to convey stormwater flows. In order to install the device, holes would have to be drilled into the walls of the inlet for the angle iron supports. Drilling the holes into the inlet walls combined with the heavy weight of the device when installed effects the overall load capacity and structural integrity of the inlet. The heavy weight of these products also increase transportation costs. There is an enormous amount of time to install this device and it requires skilled workers to manufacture and perhaps several individuals to install the device. At least one lane of traffic would have to be closed during the installation process.

U.S. Pat. No. 5,403,474 (Emery), discloses a portable curb inlet sediment filter which has a box filter frame, to be filled with particulate filter medium, such as gravel, for sediment removal, and an overflow chamber. The overflow chamber has at least one baffle panel in order to provide a hydraulic opening and a peripheral end cap chamber. The end cap chamber is gravel filled in order to clarify water escaping around the front of the frame and into the hydraulic opening through the side panel. The filter frame and baffle panels are a mesh construction having apertures smaller in size than the particles of gravel to be contained. This device is bulky and is placed in front of curb inlets thus protruding into the street which could be traffic hazard to passing motorist, especially during night-time driving. Also, if damaged or struck by a vehicle, the gravel and other filtration material from the device can damage the vehicle or litter the pavement or surrounding area. The device was designed only to be used as a temporary sediment control measure and can not be manufactured with various spaced hydraulic openings. The device can also impede snow plows and street maintenance equipment by protruding into traffic lanes.

The prior art discloses filters which combine cinder blocks, wire screens, stone riprap, fabric fences, straw bales, sand bags, or sack gabions staked tightly around the perimeter of the inlet, to serve as a Storm Water Pollution Prevention Plan (SWPPP) measure. Filters constructed with these materials are hazardous to the traveling public because they are sometimes placed within clearzones of the roadway and may protrude into traffic lanes, necessitate frequent maintenance, are labor intensive, costly, and clog the storm sewer drainage pipes when loosened or disturbed.

The disadvantages of the prior art are overcome by the present invention, hereinafter disclosed which is lightweight, does not require clamps, welds, nuts, bolts, screws, drilling, is reliable due to the simplistic design, is self-relieving, is inexpensively manufactured and maintained compared to the prior art.

BRIEF SUMMARY OF THE INVENTION

Accordingly, the present invention provides a simple and yet highly efficient means of intercepting unwanted debris or sediment before entering curb inlets. Several objects of the invention are:

(a) to provide a curb inlet filter easily adapted to pre-cast and cast-in-place curb inlets and does not effect the structural integrity of the inlet;

(b) to provide a curb inlet filter for pre-cast and cast-in-place curb inlets that is nonmetallic and made of light-weight recyclable plastic resins of sufficient strength, durability, rigidity and flexibility to withstand environmental changes;

(c) to provide a curb inlet filter for pre-cast and cast-in-place curb inlets which will release from a fixed position without human assistance to allow debris to pass;

(d) to provide an improved curb inlet filter for pre-cast and cast-in-place curb inlets which is extremely safe to install by one worker without the aid of any heavy machinery;

(e ) to provide a curb inlet filter for pre-cast and cast-in-place curb inlets that is quickly installed with an adhesive (epoxy) and does not involve any welds, clamps, nuts, screws, clips, heating, cutting, hammering or drilling into the curb inlets or modifying the structural integrity of curb inlets;

(f) to provide a curb inlet filter for pre-cast and cast-in-place curb inlets that can be easily adopted to inlets of varying standard and nonstandard dimensions or materials;

(g) to provide a curb inlet filter for pre-cast and cast-in-place curb inlets that can be produced with various spaced hydraulic openings through which debris or sediment of varying sizes may pass into the storm sewer or be prevented from entering the storm sewer;

(h) to provide a curb inlet filter for pre-cast and cast-in-place curb inlets that can be used with grate inlets;

(i) to provide a curb inlet filter for pre-cast and cast-in-place curb inlets that will move open to allow unwanted debris to pass into the storm sewer system during periods of heavy rainfall;

(j) to provide a curb inlet filter for pre-cast and cast-in-place curb inlets which does not protrude into the streets obstructing traveling motorists, cyclists, pedestrian traffic, and the like;

(k) to provide a curb inlet filter for pre-cast and cast-in-place curb inlets which does not interfere with the operations of snow plows, street cleaning equipment, asphalt paving machines, and the like;

(l) to provide a curb inlet filter for pre-cast and cast-in-place curb inlets that will yield an important safety function by preventing the entrance of balls, toys, and the like, which may cause a child to enter the curb inlet to retrieve a lost object;

(m) to provide a curb inlet filter for precast and cast-in-place curb inlets which has aesthetic value, can be produced in a variety of colors-black is the preferred color, (n) to provide a curb inlet filter for pre-cast and cast-in-place curb inlets that can be produced with various sized hydraulic openings to serve as a temporary or permanent Storm Water Pollution Prevention Plan (SWPPP) measure; and (o) provide a curb inlet filter for pre-cast and cast-in-place curb inlets in which the transportation costs are inexpensive.

Further objects and advantages are to provide a curb inlet filter for conventional pre-cast and cast-in-place curb inlets which may serve as a permanent debris intercepting device, or temporary storm water pollution prevention measure that is inexpensive to manufacture, sturdy, serves as a safety device, and can be reused repeatedly in all climates. The invention is firmly attached to the top front inside wall of curb inlets with an all-weather adhesive, thus, there is no need for drilling, grouting, welding, or structural modifications to the curb inlets. The invention offers the flexibility, ease of installation and maintenance of resin materials while also offering the durability of concrete. Still further objects and advantages will become apparent from a consideration of the ensuing description and drawings.

BRIEF DESCRIPTION OF THE DRAWING

In the drawings, closely related figures have the same number but different alphabetic suffixes. In the preferred embodiment shown in FIG. 1, two embodiments of the invention are positioned in the opening of a conventional curb inlet.

REFERENCE NUMERALS IN DRAWINGS

| | |
|---|---|
| 21 | conventional curb inlet |
| 23 | adhesive panel |
| 24 | all-weather adhesive (epoxy) |
| 26 | vertical members |
| 27 | horizontal members |
| 28 | opening of curb inlet |
| 29 | front side walls of curb inlet's opening |
| 30 | storm drainage pipe |
| 31 | front top wall of curb inlet's opening |
| 32 | bottom wall of curb inlet's front opening |
| 33 | top of roadway |
| 35 | top of curb |
| 37 | manhole cover |
| 40 | self-relieving position |

DETAILED DESCRIPTION OF THE PREFERRED EMBODIMENTS

Figure 1:
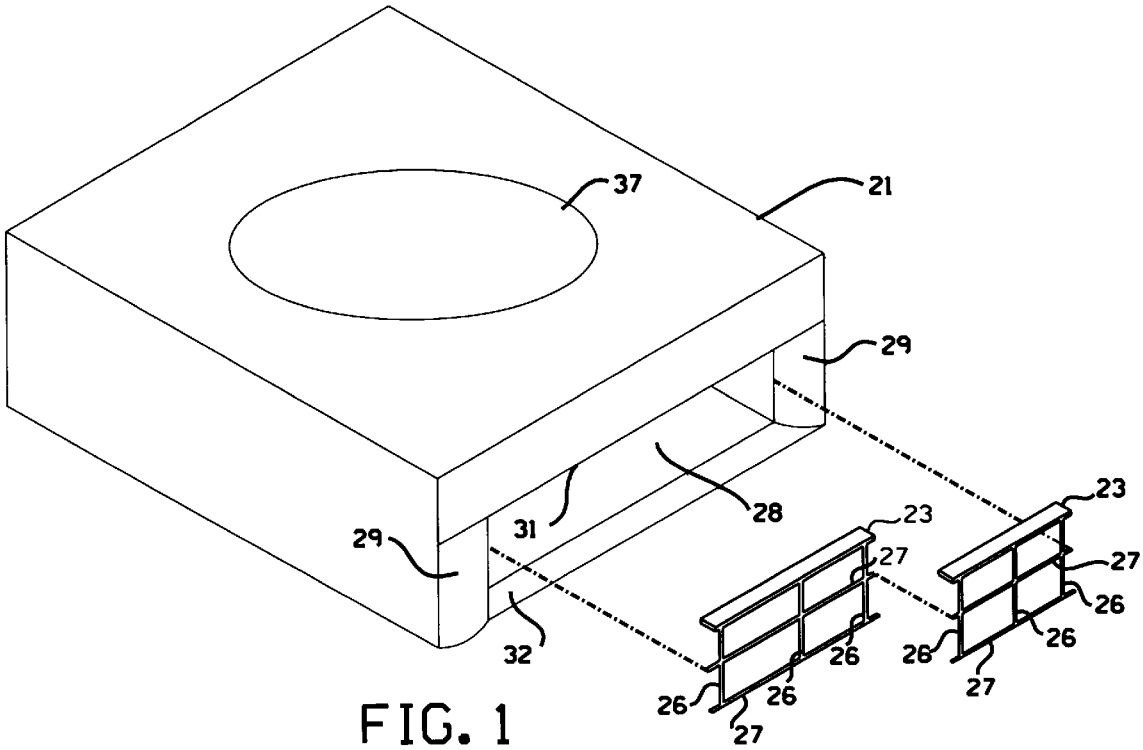
FIG. 1 shows two embodiments of the invention projected from a curb inlet
Figure 2:
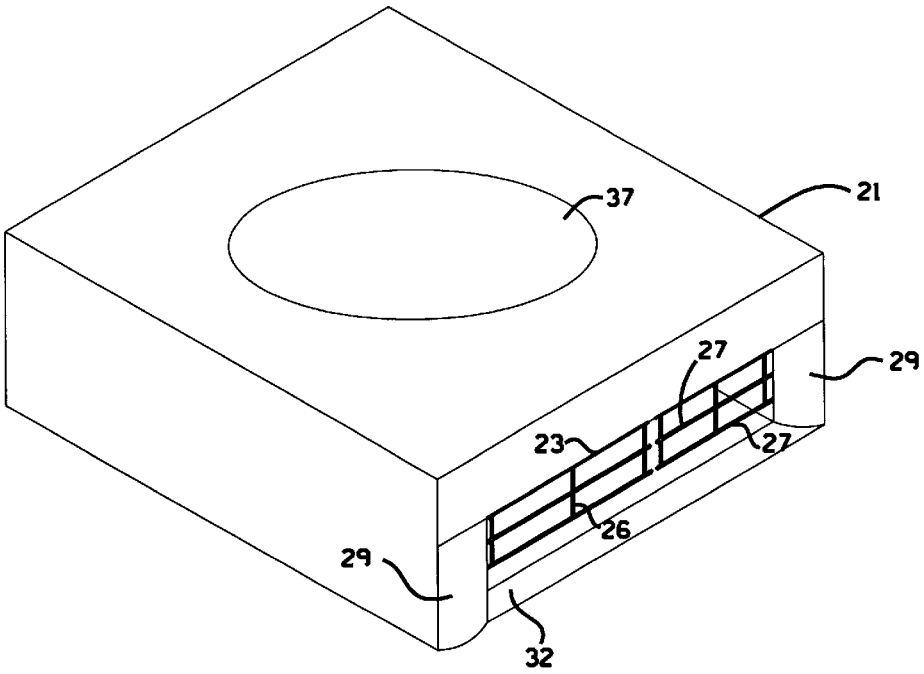
FIG. 2 shows embodiments of the invention positioned in-place within the opening of a curb inlet.
Figure 3:
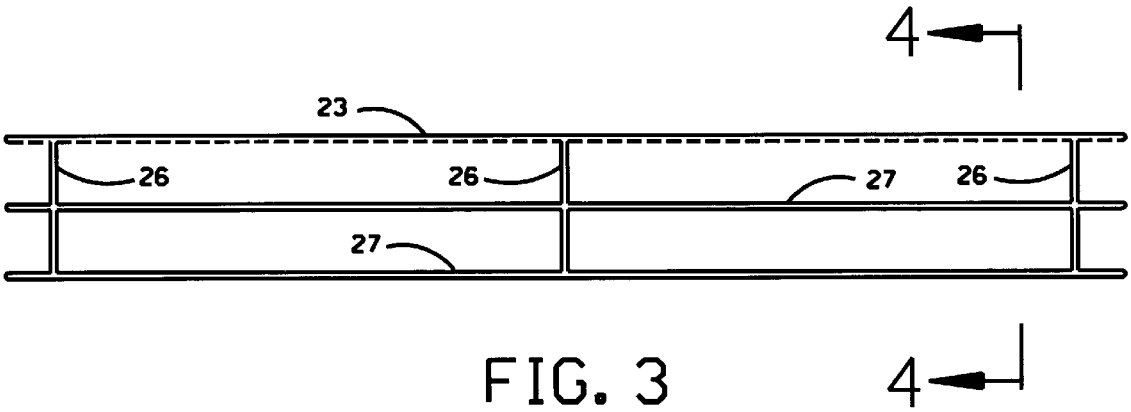
FIG. 3 shows the front view of the invention.

Two of the preferred embodiment of the invention are projected from the curb inlet as illustrated in FIG. 1 (isometric view) and depicted in-place in a curb inlet as illustrated in FIG. 2 (isometric view). The typical embodiment is one-molded piece consisting of a screened grid configuration of vertical members 26 and tubular horizontal members 27 having a uniform cross section as illustrated in FIG. 3 (front view) and FIG. 4 (end view) and an adhesive panel 23.

Figure 4:
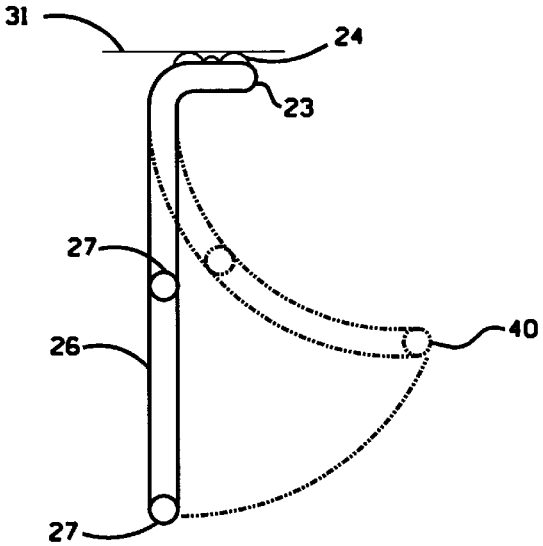
FIG. 4 shows an end view of the invention along line 4—4 of FIG. 3, with the self-relieving position projected.

As the flow/debris accumulation pressure increases, the invention will move/open inward from the fixed position to the self-religning 40 position as illustrated in FIG. 4. As the flow/debris accumulation pressure decreases, the screened grid will move/return to the original position; all performed without the need for human assistance.

The screened grid configuration of the preferred embodiment consists of uniform sturdy, light-weight vertical members 26, and horizontal members 27 (FIGS. 3, 4, and 5), is typically 29 inches in length and 4 inches in height, such that 2 embodiments of the invention may accommodate the 5 feet×6 inch opening of a conventional curb inlet. The adhesive panel 23 is typically ¼ inches in thickness and projects 1½ inches in depth. The screened grid configuration of the preferred embodiment consists of uniform vertical 26 and horizontal 27 members typically ¼ inches in diameter. The outer ends of the horizontal members 27 are typically rounded to avoid snagging and personal injury. Also, the screened grid configuration of rounded members 26 and 27 allow fluids to pass without any significant resistance.

The invention may be manufactured from various conventional light-weight and sturdy materials or resins in prior art regulations, such as polyethylene, polypropylene, acrylonitrile butadiene styrene, polyurethane, vinyl, nylon, rubber, various recyclable and elasticized materials, various plasticized or laminated fibrous materials and fiberglass-resins, foamed plastics of saturated polyester or foamed thermoplastic polyester resins, that can withstand various temperature changes, resist the prodding forces of street sweeping and vacuum cleaning equipment, withstand casual bending without fracturing and return to the original position.

When completely formed, the overall typical dimensions of the invention unit are roughly 29 inches (length)×4 inches (height) which will allow 2 embodiments of the invention to easily be positioned within the standard 5 feet (length)×6 inch (height) opening of a conventional cast-in-place or pre-cast curb inlet 21. Curb inlets with one or more extensions only require two of the invention for each extended section which are typically 5 feet in length and 6 inches in height. For example, a curb inlet with one extension would require four units of the preferred invention and curb inlets with 2 extensions would require six units of the preferred invention.

Figure 6:
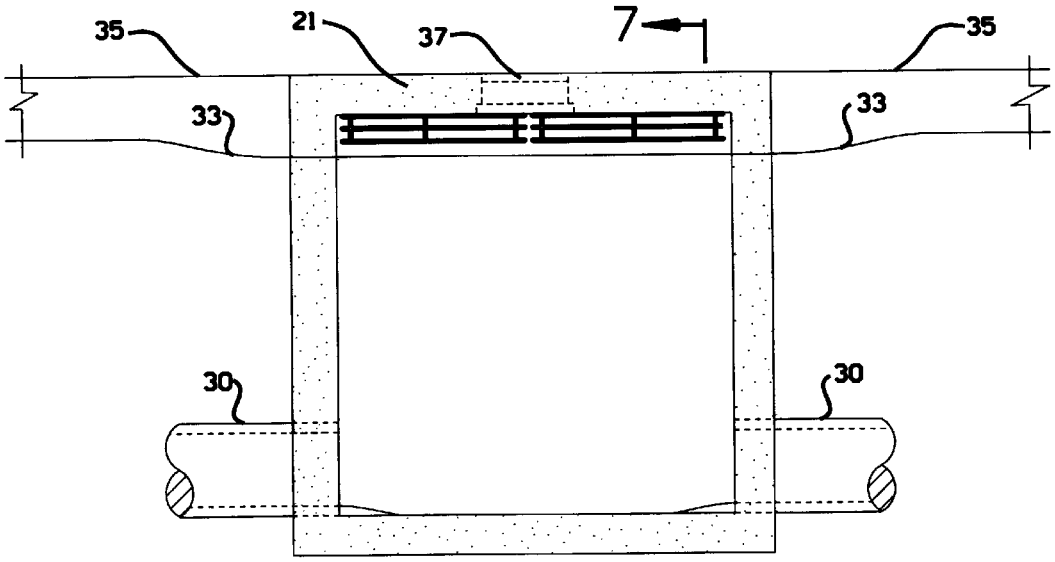
FIG. 6 shows a front view of two embodiments of the invention, positioned in a complete curb inlet.
Figure 7:
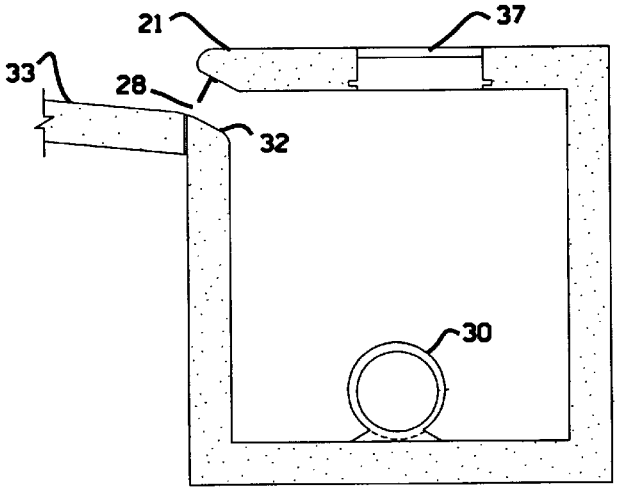
FIG. 7 shows an end view of the invention, along line 7—7 of FIG. 6.
Figure 8:
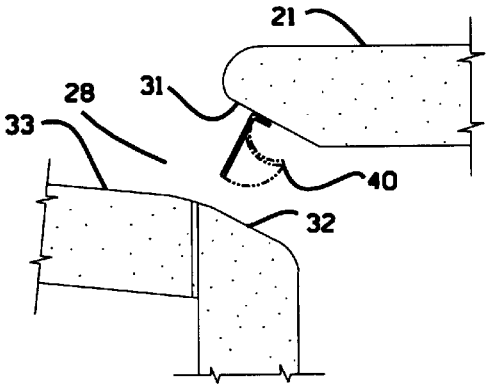
FIG. 8 shows a cut-a-way end view of FIG. 7, of the invention positioned in the opening of a curb inlet, with the self-relieving position projected.

To install the invention, the mounting surface 31 of the curb inlet should be free of any contaminants which might adversely affect the adhesive bond. A conventional traffic bonding all-weather (−40 degrees F. to 180 degrees F.) adhesive 24, is applied, of sufficient quantity and strength, to the top of the adhesive panel 23 to permanently anchor the invention to the curb inlet 21. The invention is placed in the opening of a curb inlet 21 with the adhesive panel 23 joined to the top wall 31 of the curb inlet 21 (FIGS. 6, 7, & 8). Conventional biodegradable fasteners or supports are used to secure the invention in place until the adhesive 24 cures. Curing time may vary (usually 12 hours–24 hours), depending on the outside temperature, and humidity.

If, during installation, a nonstandard curb inlet's length (shorter than the conventional 5 foot standard length) is encountered, the ends of the adhesive panel 23 and horizontal members 27 can simply be field cut, with a sharp tool such as a knife or utility scissors, to the desired length and installed as described previously. The distance from the bottom horizontal member 27 to the bottom wall of the curb inlet 21 leaves a clear space of typically 2 inches. The 2 inches clear space would allow foreign objects less than 2 inches to pass into the storm sewer system (FIG. 7) which are generally light and small enough to flow throughout the stormsewer trunkline. For example, leaves, sediment, small paper items and cups, may enter the storm sewer trunkline. Non-perishable items and common roadside debris greater than 2 inches in nominal size, such as aluminum cans, bottles, leather shoes, hats, and the like, would be intercepted and not allowed to enter the curb inlet 21.

The wide spacing of hydraulic openings, of the screened grid configuration, are advantageous where there is a lengthy period between maintenance inspections. To avoid the invention from clogging with debris, causing flooding into the street, the wide hydraulic openings in the screen, will allow some debris to escape.

Figure 14A:
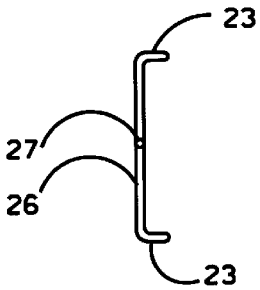
FIGS. 14A to 14C show the end views of various embodiments of the invention, with top and bottom adhesive panels, sized to accommodate the entire opening (height) of a curb inlet.
Figure 14B:
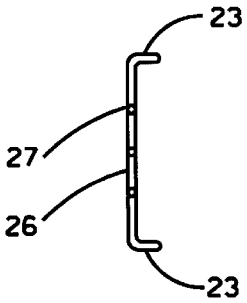
Figure 14C:
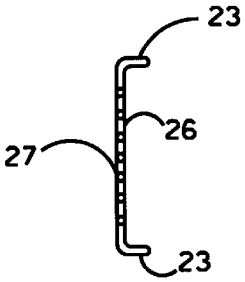

Various possibilities of forms and modifications may be made within the scope of the present invention. The embodiments of the invention may change from those described although the components function in the same manner as described to achieve the purpose of the present invention. For example, by changing the size and quantity of the flow openings, the present invention can be tailored for various debris filtering applications. Specifically, for use as a sediment inhibitor for either permanent or temporary storm water erosion pollution prevention measures. The diameter of the screened configuration of horizontal 27 and vertical members 26 can be as small as 1/16 inch. FIGS. 13A, 13B, 13C, 13D, 13E, 13F, and 13G (front views) and FIGS. 14A, 14B, and 14C (end views) illustrate some of the various embodiments of the invention. Each embodiment can also be manufactured in a variety of colors; black is the preferred color.

Figure 9:
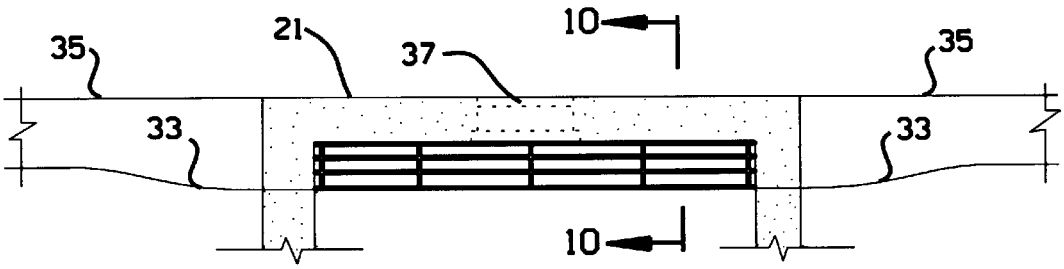
FIG. 9 shows a front view of an embodiment of the invention, with top and bottom adhesive panels, positioned in the entire opening of a curb inlet.
Figure 10:
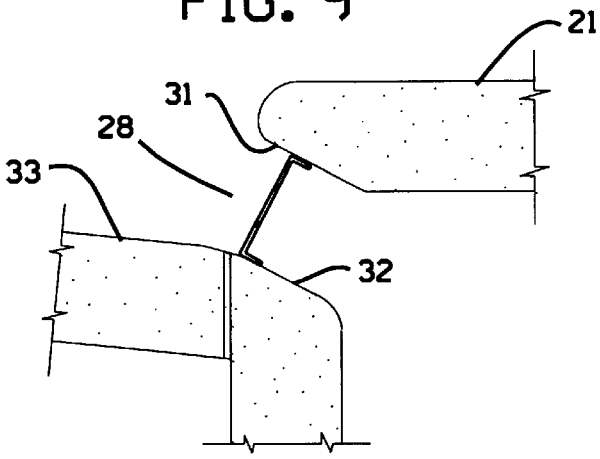
FIG. 10 shows a cut-a-way end view along line 10—10 of FIG. 9.

The overall dimensions of another embodiment of the invention, is roughly 5 feet (length)×5⅞ inches (height) and can easily be positioned within the standard 5 feet (length)×6 inch (height) opening of a conventional curb inlet 21 as illustrated in FIG. 9 (front view) and FIG. 10 (end view). The embodiments have adhesive panels 23 on each end. The adhesive 24 is applied to either the top adhesive panel 23 or bottom adhesive panel 23 only for temporary applications or applied to both adhesive panels 23 for permanent applications. If, during installations, a non-standard smaller curb inlet 21 is encountered, the ends of the adhesive panels 23 and horizontal members 27 can simply be field cut to the desired length and installed as described previously. Conventional curb inlets 21 with one or more extensions can be position as described previously.

Figure 11:
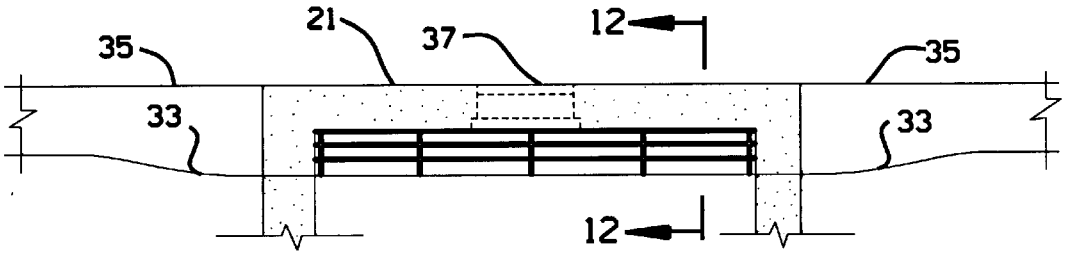
FIG. 11 shows a front view of an embodiment of the invention, with a top adhesive panel, positioned in the entire opening of a curb inlet.
Figure 12:
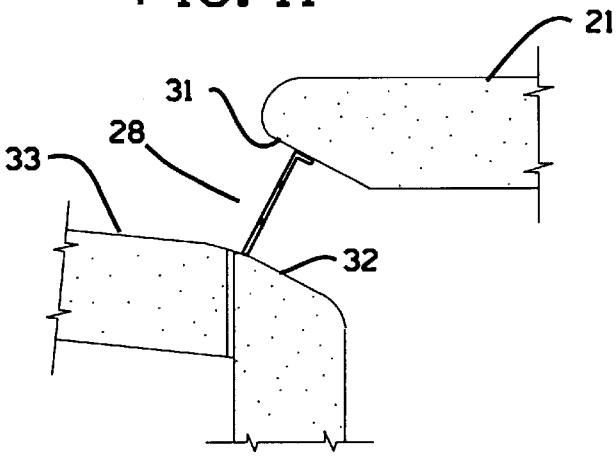
FIG. 12 shows a cut-a-way end view of the invention, along line 13—13 of FIG. 12.
Figure 13A:
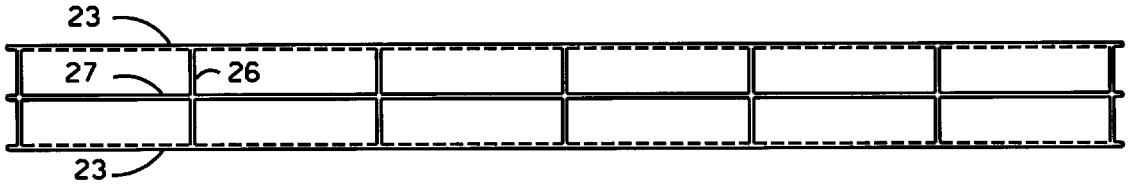
FIGS. 13A to 13G show the front views of various embodiments of the invention, with top and bottom adhesive panels, sized to accommodate the entire opening (length) of a curb inlet.
Figure 13B:
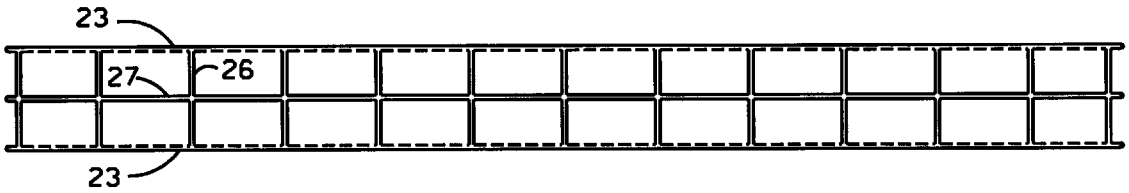
Figure 13C:
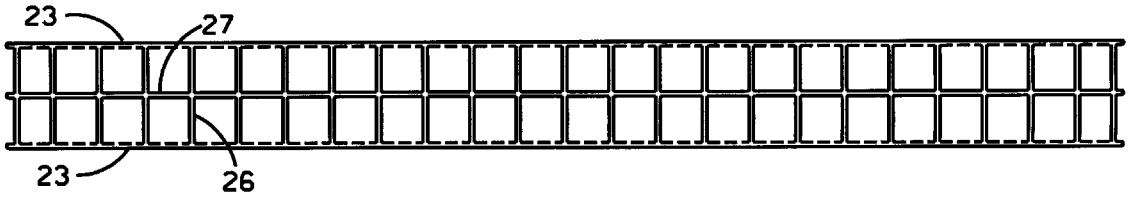
Figure 13D:
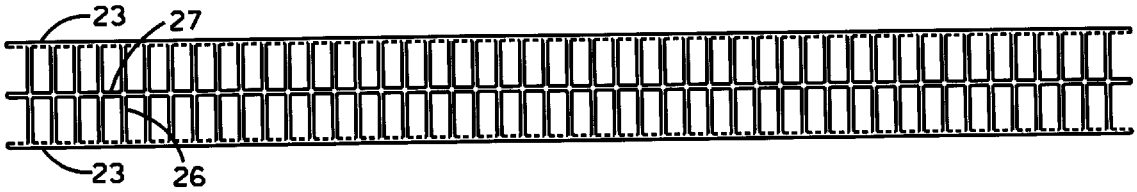
Figure 13E:
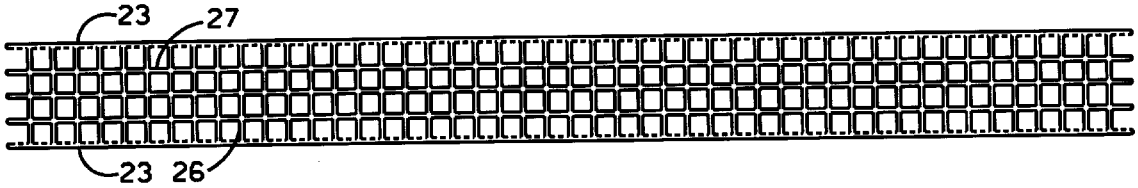
Figure 13F:
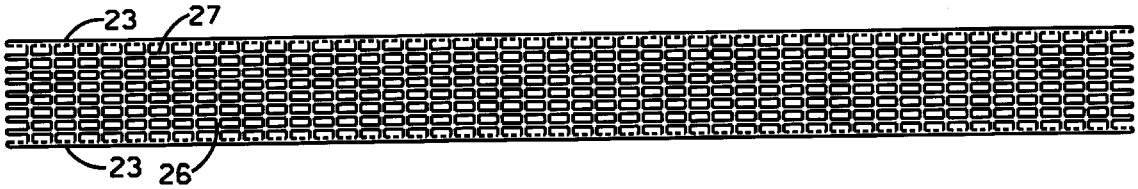
Figure 13G:
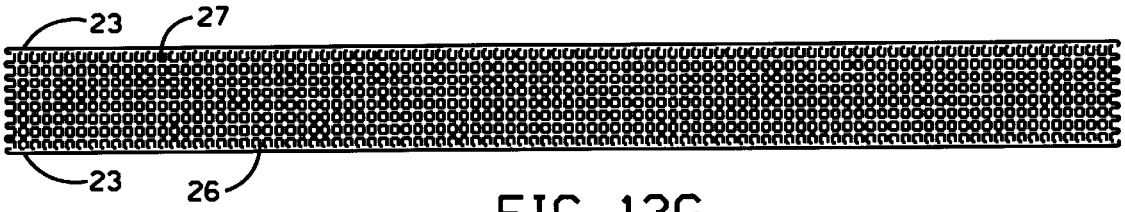

Another embodiment of the invention has only one adhesive panel 23 as illustrated in FIG. 11 (front view) and FIG. 12 (end view). The adhesive 24 is applied to the adhesive panel 23 and which can be mounted to the top wall of the curb inlet 31 or mounted to the bottom wall 32. If, during installations, a non-standard smaller curb inlet is encountered, the ends of the adhesive panels 23 and horizontal members 27 can simply be field cut to the desired length and installed as described previously.

From the description above, a number of advantages of our invention become evident:

(a) The use of various colors can provide some aesthetic value, especially for certain subdivisions and communities.

(b) The invention can be molded of recyclable materials, which is consistent with the environmentally debris reducing effectiveness of the device.

(c) Regardless of the embodiment used, the structural integrity of the existing curb inlets would not be effected due to the inventions light-weight and not requiring mechanical affixing means.

(d) Only one person is needed to install the device.

(e) Installation time is fifteen minutes or less (including traffic control setup).

f) The invention is inexpensive to manufacture.

(g) The invention is reliable, durable and reusable.

(h) The invention can be removed quickly without effecting the structural integrity of the existing curb inlets.

(i) If accidentally removed from an inlet and positioned in a lane of traffic and struck by a traveling vehicle, the device would not damage the vehicle, when compared to damage that could be done if the vehicle struck an aluminum or cast iron grate.

(j) If accidentally broken and lodged in the curb inlet, the invention is light enough to pass through the storm sewer trunkline to the discharge points.

(k) The invention will not interfere with pedestrian, bicycle or vehicular traffic, snow plows, asphalt laying machines, street sweeping equipment, and the like.

(l) The invention is practically immune to vandalism because it is made of plasticized materials, in lieu of valuable cast iron, steel, aluminum or the like.

(m) The invention provides a valuable safety function by intercepting toys or the like before entering the curb inlet, and (n) The invention can be used with grate inlets.

Figure 5:
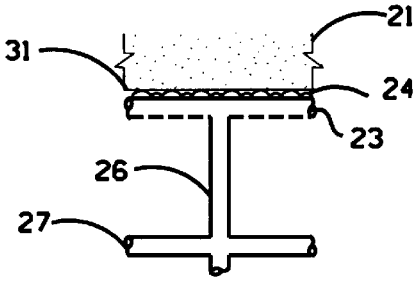
FIG. 5 shows a cut-a-way front view of the adhesive and adhesive panel of the invention.

When manufactured by a prior art plastic injection molding process, the invention is ready for installation. The manner of using the invention consists of placing all-weather adhesive 24 along the top part of the adhesive panel 23. The invention is then placed inside the front opening of the curb inlet 28 by affixing the adhesive panel 23 to the top wall of the curb inlet 31 (FIGS. 4, 5, and 8). With the preferred invention, there is a 2 inch clearance space (see FIG. 8), temporary biodegradable supports may be needed to secure the invention in-place until the adhesive 24 cures.

With other embodiments supports may not be needed. To install the invention in the opening (FIGS. 9, 10, 11 and 12) simply apply the adhesive 24 to the adhesive panel 23 and position the invention on the bottom wall of the curb inlet 32 and position the top wall of the curb inlet 31.

To remove the invention, simply insert a standard flat-head screwdriver between the adhesive panel 23 and the top 31 or bottom wall 32 of the curb inlet and pry the inlet free from the curb inlet 32. The invention can be repositioned in the same curb inlet 21 or positioned in another curb inlet 21 by following the above stated procedures. Also, if the invention is damaged, it can be recycled.

Accordingly, the reader will see that because the invention is made of plasticized materials, it is inexpensive to manufacture, can be installed quickly and easily by one person, does not effect the structural integrity of existing curb inlets because no drilling, screwing, welding, or hammering is involved for installation. In addition, the invention is a low maintenance solution to the problem of water contamination of natural lakes, rivers and stream-beds. The low maintenance costs, for periodic removal of debris collected on the screen, is a small price to pay for generations of clean water for everyone. Furthermore, the invention has additional advantages in that:

it is the most inexpensive device for intercepting debris or sediment runoff before entering the storm sewer trunkline.

it provides a debris and sediment filtering system which will not interfere or impede with the operations of street cleaning equipment, asphalt paving machines, snow plows, or the like.

it provides a screen and filtration insert for curb inlets that can be produced with various sized hydraulic openings to serve as a temporary or permanent storm water erosion pollution prevention measure.

it provides a debris and sediment screen with a relieving means which will release from a fixed position without human assistance and return to the original fixed position without human assistance.

Although the description above contains many specificity's, these should not be construed as limiting the scope of the invention but as merely providing illustrations of some of the presently preferred embodiments of this invention. The detailed description and specific examples, while indicating preferred embodiments of the invention, are given by way of illustration only, since various changes and modifications within the spirit and scope of the invention will become apparent to those skilled in the art from this detailed description.

While the invention has been described in connection with what is presently considered to be the most practical and preferred embodiment, the invention is not to be limited to the disclosed embodiment but is intended to cover various modifications and legal equivalent arrangements included within the spirit and scope of the appended claims which scope is to be accorded the broadest interpretation so as to encompass all such modifications and legal equivalents structure.

What is claimed:

1. A plastic self-relieving curb inlet filter, formed from a group of plasticized materials, for allowing fluids to pass and restricting the passage of debris, various sized sediment, small animals, children, and toys into a curb inlet opening having horizontal and vertical dimensions, a perimeter with boundaries and a front top inside wall, said plastic self-relieving curb inlet filter comprising:

a molded plastic self-relieving curb inlet filter, of substantially the same boundaries as the perimeter of said curb inlet, having a top horizontal attachment panel, said top horizontal attachment panel, having thickness, depth, an adhesive surface, and an outer edge, wherein said top horizontal attachment panel has a horizontal dimension less than the horizontal dimension of said curb inlet opening; and a grid configuration of hydraulic openings, consisting of tubular horizontal members, of equal length and thickness of said top horizontal attachment panel, positioned parallel to and below said top horizontal attachment panel; and tubular vertical members, of equal thickness to said top horizontal attachment panel and said tubular horizontal members, positioned perpendicular to said tubular horizontal members, and joined at 90 degrees to said outer edge of said top horizontal attachment panel, and with vertical dimension less than the vertical dimension of opening of said curb inlet; and whereas adhesive is fixed to said adhesive surface of said top horizontal attachment panel to attach said top horizontal attachment panel to said front top inside wall of said curb inlet opening, whereas said plastic self-relieving curb inlet filter can be configured with a plurality of said tubular horizontal and vertical members positioned for various sizes of said hydraulic openings; and whereas the accumulation of debris or sediment moves said plastic self-relieving curb inlet filter from a fixed position to allow said debris or sediment to pass into said curb inlet opening, wherein said plastic self-relieving curb inlet filter returns to said fixed position, after allowing said debris or sediment to pass therethrough.

2. A plastic curb inlet filter, formed from a group of plasticized materials, for allowing fluids to pass and restricting the passage of debris, various sized sediment, small animals, children, and toys into a curb inlet opening having horizontal and vertical dimensions, a perimeter with boundaries, a front top inside wall and a front bottom inside wall, said plastic curb inlet filter comprising:

a molded plastic curb inlet filter, of substantially the same boundaries as the perimeter of said curb inlet, having a top horizontal attachment panel, said top horizontal attachment panel, having thickness, depth, an adhesive surface, and an outer edge, wherein said top horizontal attachment panel has a horizontal dimension less than the horizontal dimension of said curb inlet opening and having a bottom horizontal attachment panel, said bottom horizontal attachment panel, having thickness, depth, an adhesive surface, and an outer edge, wherein said bottom horizontal attachment panel has a horizontal dimension less than the horizontal dimension of said curb inlet opening; and a grid configuration of hydraulic openings, consisting of tubular horizontal members, of equal length and thickness to said top horizontal attachment panel and said bottom horizontal attachment panel, positioned parallel to and below said top horizontal attachment panel and positioned parallel to and above said bottom horizontal attachment panel; and tubular vertical members, of equal thickness to said top horizontal attachment panel and said bottom horizontal attachment panel and said tubular horizontal members, positioned perpendicular to said tubular horizontal members, and joined at 90 degrees to said outer edge of said top horizontal attachment panel and joined at 90 degrees to said outer edge of said bottom horizontal attachment panel, and with vertical dimension less than the vertical dimension of opening of said curb inlet; and whereas adhesive is fixed to said adhesive surface of said top horizontal attachment panel to attach said top horizontal attachment panel to said front top inside wall of said curb inlet opening and said adhesive is fixed to said adhesive surface of said bottom horizontal attachment panel to attach said bottom horizontal attachment panel to said front bottom inside wall of said curb inlet opening, whereas said plastic curb inlet filter can be configured with a plurality of said tubular horizontal and vertical members positioned for various sizes of said hydraulic openings; and whereas said plastic curb inlet filter is fixed in position.

* * * * *